US008011047B2

(12) United States Patent
Mandelzis et al.

(10) Patent No.: US 8,011,047 B2
(45) Date of Patent: Sep. 6, 2011

(54) SPINAL RELAXATION APPARATUS

(76) Inventors: Ronen Mandelzis, Hadera (IL); Ronen Tuchfeld, Maor (IL)

( * ) Notice: Subject to any disclaimer, the term of this patent is extended or adjusted under 35 U.S.C. 154(b) by 0 days.

(21) Appl. No.: 12/441,750

(22) PCT Filed: Sep. 19, 2006

(86) PCT No.: PCT/IL2006/001092

§ 371 (c)(1),
(2), (4) Date: Mar. 18, 2009

(87) PCT Pub. No.: WO2008/035323

PCT Pub. Date: Mar. 27, 2008

(65) Prior Publication Data

US 2009/0320208 A1 Dec. 31, 2009

(51) Int. Cl.
*A47C 27/08* (2006.01)

(52) U.S. Cl. ..... 5/725; 5/689; 5/740; 5/727

(58) Field of Classification Search ..... 5/689, 638, 5/725, 727, 728, 740

See application file for complete search history.

(56) References Cited

U.S. PATENT DOCUMENTS 2,810,920 A * 10/1957 Carruth ..... 5/725
3,210,781 A * 10/1965 Pollock ..... 5/718
3,534,417 A * 10/1970 Boyles ..... 5/728
3,846,857 A * 11/1974 Weinstock ..... 5/727
4,054,960 A * 10/1977 Pettit et al. ..... 5/631
4,365,371 A * 12/1982 Boussaroque ..... 5/728
5,426,798 A * 6/1995 Guarino ..... 5/725
5,778,887 A * 7/1998 Curtiss ..... 128/845
5,960,496 A * 10/1999 Boyd ..... 5/722
6,192,537 B1 * 2/2001 Miki ..... 5/689
7,191,483 B2 * 3/2007 Hochschild ..... 5/740

* cited by examiner

*Primary Examiner* — Michael Trettel
(74) *Attorney, Agent, or Firm* — Vladimir Sherman; Professional Patent Solutions

(57) ABSTRACT

A spinal-length mattress including a means for providing buoyancy to a human torso and abdomen thereon; attached to the mattress at one end, a pelvic support portion; and attached to the mattress at an opposite end, a head rotation stabilization portion having an air passage opening allowing a person to breathe freely when resting in a face down position thereon. By supporting the pelvis and stabilizing the head to substantially limit motions of the neck, a central cushion (preferably dominated by a "shape memory foam" filling) allows the spinal column to passively distribute all directional stresses—including those deriving from body mass and from muscle tension. Thus relieved of stress, disks between spinal bones begin to return to their respective naturally compliant symmetrical shapes; thereby generally providing a long term benefit in exchange for a quarter hour or a half hour of regular prone-oriented engagement with the mattress.

10 Claims, 2 Drawing Sheets

SPINAL RELAXATION APPARATUS

TECHNICAL FIELD

The present invention generally relates to a mattress that is designed to help promote spinal relaxation for a person passively resting face down thereon, and thereby helping to restore normal thresholds for relates neurological pathways. More specifically, the present invention relates to a "Spinal Relaxation Apparatus" that is preferably capable of firstly providing stress relief to all disks, ligaments, tendons, and muscles associated with improving proper back posture, and secondly, to torso and abdominal organs—in that spurious spinal-sensation related reactions are mitigated; thereby allowing healthy feed-back and feed-forward neural controls to properly dominate respective organ functions.

BACKGROUND ART

Simply stated, there is a longstanding problem of providing relaxation for the nervous system and spinal column. Individuals exacerbate asymmetrical experiential anomalies to form and reinforce abnormal spinal stress affecting the nervous system; which often perpetuate into chronic physiological conditions. Pain, fatigue, false organ sensation, circulatory perturbations, and pulmonary dysfunctions are among the countless combinations of otherwise nondescript discomforts that trouble many people, whose primary incapacity is a failure to regularly return to a body mode that is conducive to the restoration of proper natural balances of anatomical forces.

In a critical aspect, the problem is to provide a general comprehensive solution for the majority of individuals, whose problematic aspects have not reached such chronic disproportions as to warrant individualized diagnosis, care and treatment by qualifies medical specialists; and certainly for those who have reached more chronic conditions. Given the ergonomic fallacies of the modern life style, a preponderance of individuals are in the process of developing anatomical perturbations, which in turn generally digress into painful clinical manifestations. While there is a need for the general public to become more aware of best practices for healthful lifestyles in general and correct body movements in specific, there is simultaneously an ongoing need to provide a condition non-specific means for ongoing stresses of the spinal column, nerve system and related systems (internal and external organs, muscular, circulatory, neurological, etc.) to undo the integrals of dysfunctional posture; and to progressively return to proper structural skeletal orientations. Furthermore, given the fickleness of most members of the general public, regarding active cooperation for the improvement of their own wellness, there is an ongoing longstanding need for passive apparatus that can help individuals to healthfulness; since cooperative measures such as proper diet and correctional exercises have only found regular adherence among faddists or in conjunctions with sometimes unrelated philosophical proponents.

The prior art addressing the aforesaid matters includes pharmaceutical remedies, dietary programs, electromechanical contraptions, and passive apparatuses; each respectively claiming some success, therapeutic or preventative. Regarding passive apparatus, there are those having patient specific conformal shapes and those of applicability to ordinary members of the general public. Among items applicable for the general public, one finds pillows, neck supports, cushions, mattresses, back braces, girdles, combinations thereof, and the likes. Now, in the field of mattresses, there are only a limited set of combinations; derived by respectively relating to the head, neck, torso, abdomen, and pelvis. Nevertheless, since mattresses are certainly not a new art, there are many specialized variations that appear in the patent literature. Examples (substantially in order of relevance) include US 2005/0283104; U.S. Pat. No. 6,154,903; U.S. Pat. No. 6,691,354; U.S. Pat. No. 7,020,918; U.S. Pat. No. 6,324,710; U.S. Pat. No. 5,086,529; U.S. Pat. No. 4,665,573; U.S. Pat. No. 4,473,913; U.S. Pat. No. 5,509,153; U.S. Pat. No. 4,989,591; U.S. Pat. No. 5,070,559; U.S. Pat. No. 5,426,798; U.S. Pat. No. 5,774,916; U.S. Pat. No. 5,025,519; US 2004/007008; U.S. Pat. Nos. 4,982,466 and 5,129,115; U.S. Pat. No. 5,604,021; RU 2240765; U.S. Pat. No. 3,885,258; U.S. Pat. No. 4,972,535; U.S. Pat. No. 6,585,328; and in the narrow subgroup related to adaptations for pregnant women U.S. Pat. No. 5,819,348; U.S. Pat. No. 7,065,817; U.S. Pat. No. 7,065,816; WO 03105634; and JP 2004089697.

Also, by way of background introduction, the present invention makes use of the term "shape memory foam" which is a specialized material that provides a simulation of buoyancy (floatation) when used in a sufficiently thick upholstery or mattress layer. Common examples (from what one may appreciate from the general literature) of a Visco-elastic or slow return "memory foam" include SUN-MATE or TEMPER FOAM (trademarks), both supplied by Dynamic Systems of Leicester, N.C., U.S.A.; a partial equivalent is a viscous gel, supplied by Canadian Posture and Seating Centre (1988) Inc., of Kitchener, Ontario, Canada, under its trademark LIQUISOF. Various patents also direct the reader to other variants of substantial equivalents such as may be learned from U.S. Pat. No. 5,994,450 Gelatinous elastomer and methods of making and using the same and articles made therefrom; U.S. Pat. No. 6,498,198 Fill for pillows and cushions; U.S. Pat. No. 6,156,842 Structures and fabricated articles having shape memory made from .alpha.-olefin/vinyl or vinylidene aromatic and/or hindered aliphatic vinyl or vinylidene interpolymers; U.S. Pat. No. 7,091,297 Shape memory polymers based on semi-crystalline thermoplastic polyurethanes bearing nanostructured hard segments; and the likes. By way of non-limiting explanation, soft texture Visco-elastic foam advocates describe it as "the optimum choice, as it creates an area which is less resistant to deformation than is the remainder of the seat cushion. This difference in "softness" or deformability allows more support or weight transfer to occur."

Briefly stated, there is a longstanding need for a passive apparatus that can help many nominal and intermediate spinal stress related sufferers to have temporary relief from such aches and pains, and preferably longer term benefits of improved mobility, nervous system functioning and overall energetic wellbeing.

DISCLOSURE OF INVENTION

The aforesaid longstanding needs are significantly addressed by embodiments of the present invention, which specifically relates to a Spinal Relaxation Apparatus. The instant apparatus is especially useful in therapeutic ergonomic interactions wherein there exists a longstanding need for a passive apparatus that can help many nominal and intermediate spinal stress related sufferers to have temporary relief from such aches and pains, and preferably longer term benefits of improved nervous system functioning, mobility and overall energetic wellbeing.

The instant invention relates to embodiments of a Spinal Relaxation Apparatus comprising: (A) a mattress portion including a means for providing buoyancy to a human torso and abdomen thereon, and the mattress portion has a length substantially equivalent to a respective human spinal column, a width at least equivalent to a width of a respective human chest, and a depth sufficient to contain therein the means for providing buoyancy; (B) attached to the mattress portion at one end of the length thereof, a pelvic support portion including a means for substantially holding weight of a respective human pelvis thereon; and (C) attached to the mattress portion at an end opposite to the pelvic support portion, a head rotation stabilization portion including (i) a means for substantially holding weight of a respective human head thereon and (ii) an air passage opening providing means for a person to breathe freely when resting in a face down position thereon.

From the outside of an abstract embodiment of the instant invention, we are looking at an ordinary mattress, shorter than what most people generally buy and having some odd void in the head space region. Perhaps, the easiest way to visualize a simple embodiment of the instant invention, its basic use, and the simple mode by which it provides benefit, is to consider a person resting face down on a mattress. Providing support for the pelvis, restricting neck and head motion, and letting the person freely breath through an air passage will together provide that the mattress section (between the pelvic support and the head stabilization portions) will determine if there will be new stresses on the spine or if there will be spinal relaxation.

From the clinical observation of the instant invention, as used by real persons, it appears that there is a progressive series of therapeutic physiological responses when this central mattress section provides a floatation type of mass distribution equilibrium. There may be many theories as to how and why the various systems of the body converge on a new balance of forces—but the pith and marrow of the thing is that after each session of substantially 15-30 minutes, people report that they feel better, that they are relieved from pains to some degree, that the benefit lasts for some time after the prone resting procedure, and the likes. On the other hand, pre-examination and post examination by medical professional(s) reveals numerous patient specific details—which are predominantly substantially positive. What is most important about this apparatus is that a most persons can use it without dependence on any help from a therapist and can get significant benefits from its use.

Essentially, a most general embodiment of the Spinal Relaxation Apparatus, substantially as herein described and illustrated, is characterized by having a spinal-length buoyancy-providing mattress having attached thereto a head rotation stabilization portion on one end and a pelvic support portion on an opposite end. Please note that the essential embodiments of the instant invention may include integrally attached lower portion(s) upon which the legs and feet may rest and/or be supported, or the likes—so long as the angle of the leg portion(s) is substantially continuous with the upper plane of the rest of the apparatus—most specifically with the pelvic support portion. Nevertheless, for special problems there may be included elevated and/or depressed portions there—but this is beyond the scope of the present invention—and may seemingly be partially gleaned from aspects of related prior arts.

Alternately stated, the instant apparatus is a structure that is designed and built from three primary parts; an inferior portion that is denser for allowing the needed supports of the pelvis; a middle (main) portion that is softer and supports the abdominal cavity; and a superior portion that is built of two lateral sides which are joinable to support the forehead, yet enabling free and easy breathing. In preferred embodiments, the instant apparatus is adjustable within the defined person attributes; and is made to be portable. More specifically, there is a preferably adjustable first strap for setting the elevation of the forehead with respect to the surface of the middle portion on which a person rests face-down, and a head rotation restriction aspect which is best embodied as an adjustable second strap over the top of the head (connecting two cushions which are respectively attached to the middle portion) such that having a shorter strap will bring the cushions closer together (near the top of the head) and thereby bring the cushions into secure contact with the cheek bones; thus restriction head rotation.

Now, according to a preferred embodiment of the instant apparatus, A body rest structure is provided which includes a body frame support for supporting the whole spine system of a human body in a prone, supporting the resting body in the prone position while maintaining proper spinal alignment, which serves to induce a mild stretch and natural floating decompression of the user's whole spine system. The head and body frame support includes an upper head piece, a chest and shoulder support platform, a lumbar support platform and a denser pelvic support piece. A viscous elastic region extends longitudinally between the pelvic support piece and the head piece to provide room for at least a portion of the weight of the chest below the shoulders to pull down on the body between the platforms. The support may include a rear supporting denser sponge surface to provide lifting support from below the hips and abdomen and shoulder support of the body. A head support for supporting the head in a downwardly facing position in order to protect the cervical spine from any rotation and extensive torque; the torso and abdomen are supported by the viscous elastic material as disclosed; and the head support includes a front portion for providing lifting support to the forehead of the body, and parallel opposed side portions for supporting opposed sides of the face. Each such side portion has an upper surface that should be joined together by a scotch strip, in order to give proper support for the forehead, yet enabling free breathing—the head support to the associated distal end of the side portion.

Specifically, many an embodiment of the instant apparatus is a medical device (providing a systems approach) that gives natural passive floating decompression to the whole spine system. The body rests on a supporting cushion structure comprising a denser pelvic support sponge, longitudinally extending torso and abdomen support for supporting the human body frame in a prone position elevated above an underlying surface and a head piece that gives proper support to the forehead while enabling free breathing. Thereby is provided natural passive floating decompression to the whole spine system is defined by:

(A) A supportive cushion below the torso, abdomen and pelvis allows the spine to float above—creating a natural passive floating decompression to the whole spine, similar to the effect on the spine while swimming in a pool (hence the term 'Swimming Pool Effect').

(B) The natural passive floating decompression enables the spine to gradually return to its optimal positioning and rejuvenate the normal spinal structures and curves.

(C) Spinal system rejuvenation is possible, due to the reduced weight that is bestowed on the spine (unloading effect).

(D) The different vertebrae drift apart gradually and return to their natural optimal positioning, thus enabling unloading stress and pressure off the discs. This gradual vertebral drift apart and even stress load is termed offloading. The Offloading of pressure and stress of the spine and vertebrae enables the disks to rejuvenate.

(E) Disk Rejuvenation can happen when the pressure on the discs is reduced. Thus enable the strengthening of the Annular Fibrosis, which can better absorb, respond and handle the pressure of the Nucleus Palposus; thus, gradually returning it to its natural size and proper location in the center of the disc. This normalization of the disk pressure enables the reactivation of the disc fluid absorption mechanism, which allows the discs to expand and regain height.

(F)—Nerves system rejuvenation can happen when the pressure on the discs is reduced and then the pressure on from the nerves roots allowing for better nerves functioning and better internal and external related organs functioning, hands, legs, neck, heart, liver, lungs, sexual organs etc. (Please note that "DBU" relates to specific therapeutic embodiments of the instant invention and to methods of providing therapy and/or treatments therewith. DBU—is a short cut for "Daily Back-Up"—this is the method we recommend using a basic embodiment of the instant invention, daily back up your whole spine system by resting face down on the apparatus for substantially 15 or 20 minutes—once or even twice per day.)

Now, many people suffer from spinal and back problems which should be responsive to decompress therapy practices and stretching treatments. Devices have been developed which are claimed to be of value in dealing with such problems, but such devices have suffered from a number of shortcomings:

(1) These prior art devices are frequently large and bulky and can be used conveniently only in a clinical or exercise center environment. They are not readily portable and do not lend themselves to use in a home or outpatient setting. However, DBU is a portable apparatus that can be carried and used on a daily base conveniently at any time at any place—at home as well as at work places PRN (per necessity as needed and derived from the person activity and or current status).

(2) Such prior art devices do not provide for unloading of the spine other than by active traction (and decompression). Such active traction devices are difficult for a patient to use; frequently the assistance of one other person is required to enable a patient to be properly placed in and use the traction (and decompression) device. However, DBU is a Natural Spine System Floating for Passive Decompression and Sinking onto the apparatus and implementing even pressure on the body surface that is in contact with apparatus enables the unloading and decompressing of the whole spine. This effect unloads pressure and stress off the spine and the pressure off the nerves roots thus enabling a natural healing process to occur. The Natural Floating Mechanism enables the body to perform a continuous decompression at its own pace. This act is neither activated nor dependent on the user level of pain but on the Spine System ability to gradually withstand Natural Decompression process.

(3) Most importantly, such prior art devices normally dictate the force to be applied to the patient, rather than allowing the patient to control the force. However, DBU allows the body its own pace of natural decompression recovery and healing with out any use of external force and the need to control. Reasoning for this is that such an external force might cause harm due to lack of sensitivity to the complexity of the spine system response.

While such prior art devices usually permit different force settings (often in incremental steps, as by changing the number of weights attached to the traction device), once the particular load is set the patient cannot vary that load and the resultant force during the exercise or therapy session. This presents a serious problem for many patients, in that exercise under a constant force causes severe pain. Typically such a patient suffers immobility in the spine and lumbar back region and must begin any exercise or therapy session slowly and under very little load. As the session continues and the patient's spine system begins to loosen, the patient should be able to increase the load and force without reaching an uncomfortable pain level.

However, DBU used by person is independent of any external or the person judgment and there is no load incurred based on such judgment. If pain occurs at the beginning the person should make only shorter sessions but more frequent to adjust to the apparatus. This allows the person to have control over his recovery and healing pace with out being dependent on external constraints such as scheduling of treatments, transportation before and after, thus applicable to i.e. mobility limited persons. Finally not being dependent on a physician instruction, and or making their own decisions and judgment, while suffering and feeling inconvenient. Many of the damages incurred due to physicians wrong judgment and complications incurred are due to inappropriate diagnosis, in process responses and medical errors.

Furthermore, according to our best understanding, because the user actually performs many micro-adjustments to his posture while resting prone (face down) on the apparatus of the instant invention—in fact the user is naturally self adjusting his own personal organic prescription for spinal relaxation and improves whole body system balance. Likewise, in each subsequent user manages session with the instant apparatus, the user's posture has shifted as a result of the last session and as a result of intermittent skeletal muscular activities—which have now caused a new integral of body imbalances. So now the user approaches his session with many micro-posture aspects which will again naturally transform as his current session proceeds. We believe that the user's natural micro-posture shifts are much more accurate than intervention by even a most experienced physiotherapist.

Furthermore, in the prior art devices, if pain increases during the session, then the patient should be able to reduce the load and force to control the pain level. These changes may of course be repeated many times during an exercise or therapy session. At the present time no exercise or therapy devices permit a patient to be "in the loop" with respect to such control and regulation of spine and lumbar back exercise and therapy. At best the user can only stop the device and manually reset the load or direct a therapist or attendant to do so. Frequent or repeated changes are difficult and inconvenient to accomplish (e.g. rolling over it if needed).

(4) Such prior art devices often put excessive stress on one or more other parts of the body while attempting to provide relief to the spine and lower back. A common and very simple exercise is where the person stands between two horizontal hand supports placed at about waist height (such as parallel bars or the backs of chairs) and then pushes up on the supports until his arms are straight and his body is lifted off the ground. While this allows the spine to stretched, it puts excessive stress on the user's hands and wrists and the position cannot be maintained for more, than a few seconds, nor can it be performed for more than a few repetitions before the person's hands and wrists become unduly fatigued.

The present invention apparatus answer may longstanding needs, since it is of considerable value to have an exercise apparatus that is a simple structure allowing for unloading of the user's spine and lumbar back region for prolonged periods, which is readily portable and usable in a variety of settings including the home environment, which does not require the presence of attendants to assist the user and which, most importantly, is under the immediate and continuous control of the user. Specifically, DBU enables the whole spine system to be relaxed with no excessive stresses incurred on other parts of the body during sessions. Most importantly it is at all times under the user immediate and continuous control.

Furthermore, while other active prior art devices put emphasis on the usefulness of exercising while decompressing, DBU is focusing on natural passive decompressing with out any constraints to other organs as well as any other distraction of the body self healing process. Such prior art exercises could even contradict and might harm the body while done in unnatural and imbalanced state.

Hippocrates, the father of medicine said "the root of all diseases can be found at the spinal column". Thomas Edison said "the doctor of the future will not treat the patient's disease but will teach the patient of proper posture and nurturing".

Many people in their daily life style create different stresses on their body and mainly on their spine system. This daily behavior affects the structure and functioning of the spine system, in particular it affects the supportive muscles, and tendons and ligaments, damage the spine flexibility, in particular creates pressure and stress on the vertebrae and discs, in particular damages the discs that incur pressure on the nerves roots and system and or spinal cord thus affecting the associated organs functioning.

Many parameters affect the spine system from birth to elderly age related to controlled and uncontrolled causes. Some parameters are related to the hereditary and inborn attributes inherited.

All these parameters added with the fact that in no time can the educated physician or medicine know all the factors, chemicals and their derivatives that affect the human body, thus the physician can never know the absolute treatment process and cure for any decease. This has created the need for DBU Method and Medical device apparatus embodiments of the present invention to enable the body to naturally adjust to all these parameters inputs during our life time cycle in order to adjust our spine system to recover and heal controlled properly by the brain and nerves system—the master computer.

The on going process of daily spinal unloading and offloading which is termed the 'Pool Floating Effect' enables the spine system to daily relax and return gradually to its natural position, enabling it to reactivate all of its proper natural functional mechanisms. Thus recovering and naturally and gradually healing thus awakening all proper healthy body functions.

The core problem is that the spine system is a very complex natural mechanism with many elements with different quantitative, qualitative and physical attributes as many as the variety of man kind.

This complex system is affected differently with regards to each person depending on the personal behavior, characteristics, knowledge and awareness and physical behavior that might affect the spine system. Another key element affecting and damaging the spine system is the external environment conditions which surround us. This environment, in which the person is functioning, has a lot to do with a variety of factors. Such would start from the domestic conditions and instruments used such as beds, chairs, mattresses and up to food and nutrition, air conditioning and even different hobbies and leisure activities.

While health is defined as the body ability to respond and adapt itself to ever changing internal and external changes, the main changes affect all organs is the spinal cord which is influenced by 24 moving spinal vertebrae which can impair the information transfer between the body and the brain via the spinal cord. The DBU method and Medical Device apparatus embodiments of the instant invention enable the spinal column and each Vertebra to return to its proper place simultaneously.

All these factors which are also inter related create a significant damaging effect on our spine system and all together they are incorporating a very complex equation with as many variables where each variable has as many coefficients that are interrelated in a very complex ways as are the number of humans.

What is typically diagnosed as spine system problems is derived from a variety of symptoms identified to which there are many different treatments. The main problems with many of the treatments are that they are creating a better temporary condition but do not provide a root cause solution which is needed to a lot of the spine system problems.

Another issue relating to treatments is how we can take all these factors into account? How can we identify them and the inter relations and then based on this identification provide treatment that is dealing with the core problems and root causes of these problems?

DBU Method and Medical Device apparatus embodiments of the present invention are addressing this problem while allowing the body to be able to take into account the complexity of the whole spine system equation, variables and coefficients described above, which is fully known only to the brain, and then gradually act to solve the problems by improving the communication between the brain and the body.

It was therefore vary important to identify the core problem which is defined as the spine system degeneration and create a new approach for a natural chiropractic treatment method supported by the DBU Method and Medical device apparatus embodiments of the present invention that take into account the complexity on one hand and the need for practical solution on the other.

The DBU Method and Medical device apparatus embodiments of the present invention are based on the following principles and objectives:

(1) Change in Human Behavior—the process approach is discipline for daily use and treatment.

(2) Natural Healing Mechanism initiated and controlled by the body.

(3) Independency from external treatments delivered by different people using different techniques and limited technology usually dealing with narrow aspect of the spine system symptoms rather then the root causes for these symptoms.

(4) Natural passive whole spine system floating and decompression process—allowing for all the system to be relieved.

(5) Unloading and Offloading of the spine system.

(6) Discs 'self natural recovering process'—Recovery and Regeneration.

Please note, the present invention will forthwith be described with a certain degree of particularity, however those versed in the art will readily appreciate that various modifications and alterations may be carried out without departing from either the spirit or scope, as hereinafter claimed.

BRIEF DESCRIPTION OF THE DRAWINGS

In order to understand the invention and to see how it may be carried out in practice, embodiments including the preferred embodiment will now be described, by way of non-limiting example only, with reference to the accompanying drawings. Furthermore, a more complete understanding of the present invention and the advantages thereof may be acquired by referring to the following description in consideration of the accompanying drawings, in which like reference numbers indicate like features and wherein.

MODES FOR CARRYING OUT THE INVENTION

The invention herein relates to spine system decompression and stretching equipment and spinal physical therapy and treatments apparatus. More particularly, it relates to such equipment for providing decompression and relaxation therapy to a person's spine system (Head, Neck, Thoracic, Lumbar, Sacrum and Coccyx) Abdominal Muscles, Ligaments and Tendons. Please recall that "DBU" relates to specific therapeutic embodiments of the instant invention and to methods of providing therapy and/or treatments therewith.

Figure 1:
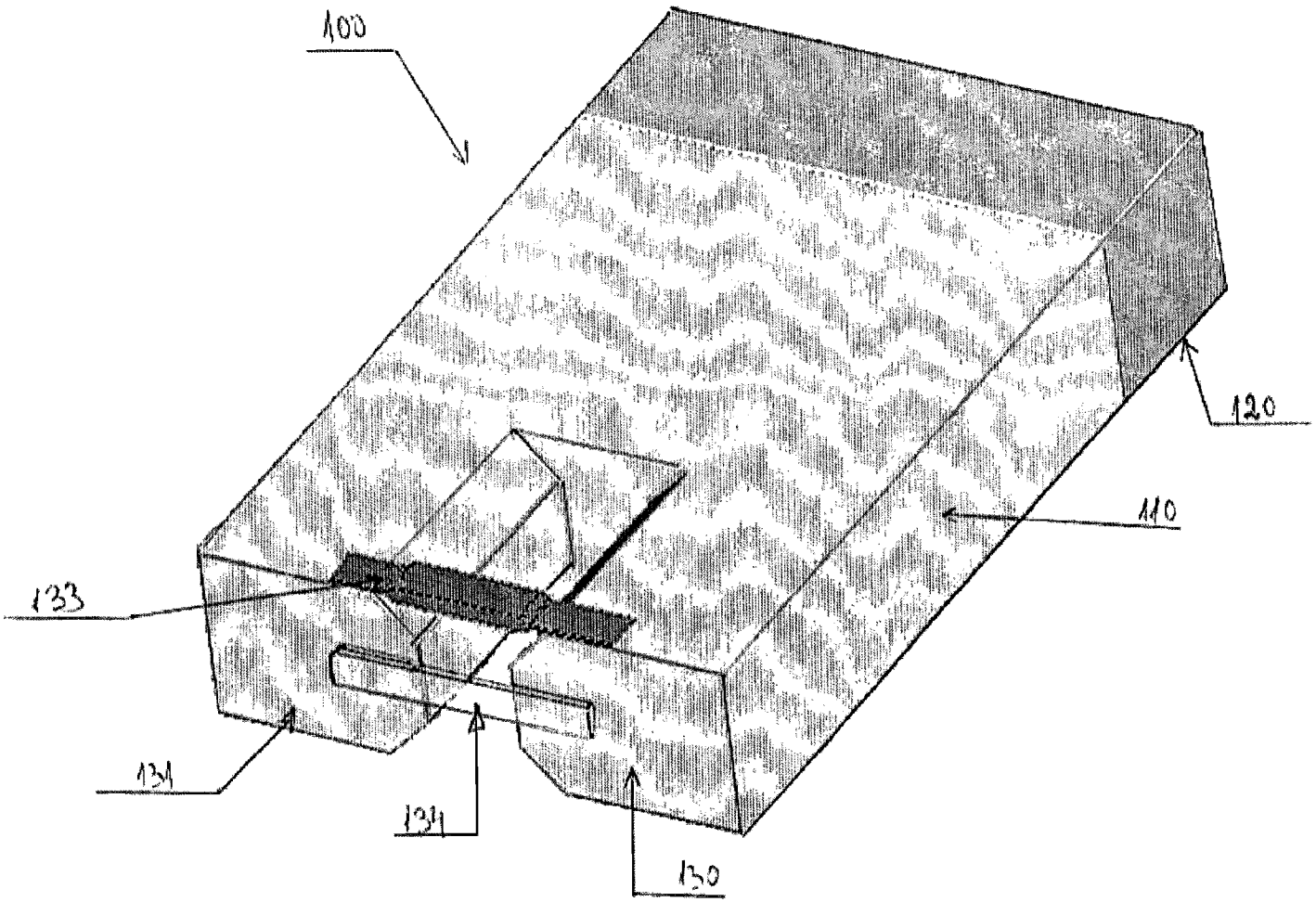
FIGS. 1 and 2 illustrate schematic views of the instant apparatus.

Embodiments and aspects of the invention may be embodied in various forms, wherein a Basic embodiment (see FIG. 1) of the instant invention relates to a Spinal Relaxation Apparatus (100) comprising: (A) a mattress portion (110) having (B) a pelvic support portion (120) at one end of the mattress portion and (C) a head rotation stabilization portion (130, 131) at an opposite end of the mattress portion.

The mattress portion (A) is including a means for providing buoyancy to a human torso and abdomen thereon, and the mattress portion has a length substantially equivalent to a respective human spinal column, a width at least equivalent to a width of a respective human chest, and a depth sufficient to contain therein the means for providing buoyancy. Of course, the portions may be wider than the chest—in which case the arms and shoulders will likewise rest on the mattress portion. Certainly, the mattress portion should be of the length corresponding to the torso and abdomen of the person using it—so it is proper that the apparatus come in sizes for infants, children, adolescents, adults, etc.

Attached to the mattress portion at one end of the length thereof, the pelvic support portion (B) is including a means for substantially holding weight of a respective human pelvis thereon. This portion may include upholstery for comfort and aesthetics—however excessive cushioning may result on a need to increase the means for providing buoyancy; which in turn will unnecessarily increase the manufacture price of the apparatus.

Attached to the mattress portion at an end opposite to the pelvic support portion, the head rotation stabilization portion (C) is including (i) a means for substantially holding weight of a respective human head thereon and (ii) an air passage opening is providing means for a person to breathe freely when resting in a face down position thereon. This might just be a spongy pillow with a canal in it for easy breathing. Alternatively, it could be a head brace or a harness. However, perhaps the easiest embodiment is two cushions connect to each other by a forehead strap—where the two cushions are respectively attached to the mattress portion According to a first variation embodiment of the Spinal Relaxation Apparatus, the means for providing buoyancy is a "shape-memory foam" layer. The Origin of Memory Foam: "In the early 1970's, NASA's Ames Research Center funded a development project designed to create a substance that could help relieve astronauts of the incredible g-forces experienced during lift-off. They believed that one of the key secrets to reducing g-forces on the body was to use a foam material that could conform to each person's shape and hold this conformity. While a foam mold of each astronaut's body shape could accomplish this, any movement would take a person out of this position and create incorrect pressure points against the body. Instead, they created a new foam material that was visco-elastic and therefore able to conform to a person's shape, but then come back to a normal shape once pressure was removed from the foam. This could allow an even distribution of pressure or body weight over the entire surface of the foam, but quickly adapt to any movements of the body. (With this amazing discovery, Fagerdala World Foams of Sweden, one of Europe's largest foam producing companies, began experiments in the 1980s to perfect it for consumer use.)"

Today, there are many types of shape memory foams, and even countless equivalents which are actually entangled threads, globs, nodules, and the likes. Memory material (e.g. foam) attributes should be: (1) Visco elastic—compressed gradually, which is not crashing immediately and locally allowing for unloading uniformly; (2) Memory—returning to shape gradually thus enabling the creation of pressure off-loading—pool effect; and (3) Typical Weight—60-120 Kg PER Cubic Metter is preferable. Sometimes, it is sufficient that Visco Elastic Foam of sufficient proportions be one of the ingredients; or Elastic Polymer; or TEMPUR Foam (http://www.miraflex.co.uk/); or "Nasco" manufacturered in Israel by kit Polymers Ltd. Factory in Kibutz Hazorea (http://night-ech.shopy.co.il/).

Please note that it is preferred to try to match the flotation characteristics to the person. Thus, Categories of Person weight v Apparatus Visco elastic material density: (A) Infants and children under 60 Kg body weight—NASCO (Visco Elastic) specific Weight of 50-70 Kg/M.sup.3; (B) Normal adolescents and adults up to 80 Kg body weight—NASCO 85-100 Kg/M.sup.3; and (C) larger adults above 80 Kg body weight—NASCO 100-120 Kg/M.sup.3. Paying attention to these variations of density may help the reader to better understand the focus of some of the non-limiting examples that are described herein.

According to a second variation embodiment of the Spinal Relaxation Apparatus, the means for providing buoyancy is a layer shape memory materials. Properly appreciated, a shape memory material is one that can be easily compressed (to come to balance with the compression force) and will slowly return to its original shape once the compression forces is removed. According, one could even conceive of including perforated hollow balls of memory alloy, and getting the same floating effect. The optimal effect is achieved when the memory material layer can counter balance the weight of a person resting on it—to produce simulated flotation equilibrium.

Figure 2:
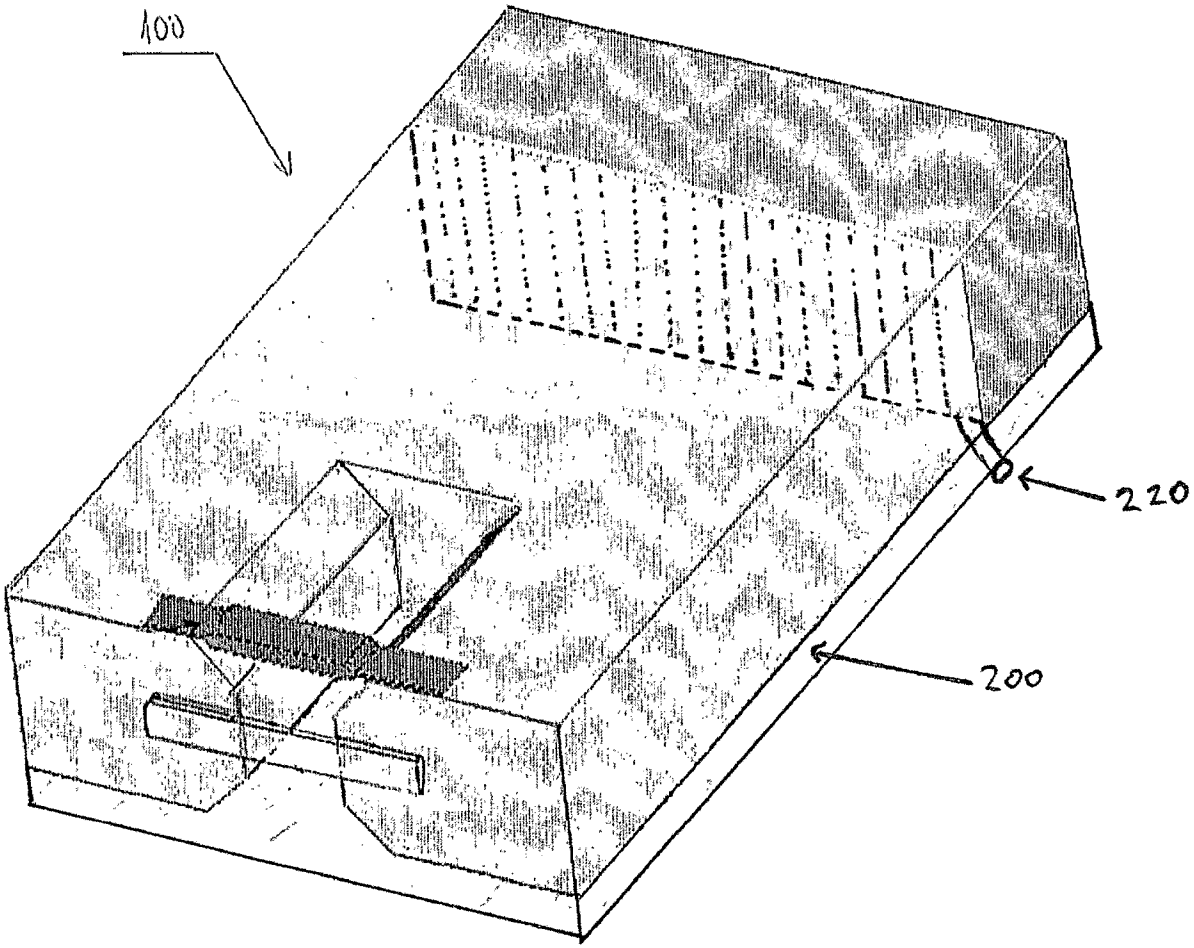

According to a third variation embodiment (see FIG. 2) of the Spinal Relaxation Apparatus, the means for providing buoyancy is a fluidized bed having a layer of inert aggregate 220), a pressurized air entry means (from underneath the aggregate) for causing the aggregate to emulate buoyancy characteristics by permeating aggregate with air flows, and an air release means for maintaining the air flow permeated aggregate within a predetermined volume. For example, a bean bag mattress (upholstered with a large plurality of breathing vents) is integrated to a pressurized air table (one having a large plurality of small vents through which pressurized air is continuously forced) will provide buoyancy—so long as the air pressure is properly regulated. Certainly there are many inert stuffing materials that are good substitutes for beans. Sometimes, some means for vibration may supplement the air flow fluidization of the stuffing—especially for stuffing materials that may clump together into larger aggregations. Nevertheless, providing vibration (of the proper frequency or program of frequencies) is a known technique for helping muscles to relax—so this is a good win-win harmony variation of the instant apparatus.

According to a fourth variation embodiment of the Spinal Relaxation Apparatus, wherein the pelvic support portion includes a layer having a substantially rigid inner shelf. On the one hand, this shelf provides support for those embodiments where the foam upholstery is excessive soft; which is a comfort feature that some people prefer. Of course the shelf does not have to be flat, since it can be shaped to conform to the front of the pelvis. On the other hand, a simple flat shelf can be used under a soft upholstered upper body-facing surface, and that shelf can be hinged to a frame on the far end from the mattress portion—thereby providing a ramp like surface descending from the lower pelvis side into the abdomen region—while still providing the basic functions weight support. Almost equivalently, the shelf can be hinges in to a central layer of the end of the mattress portion—providing a near identical ramp up from the abdomen to the lower pelvis side—again while still providing the basic functions weight support.

According to a fifth variation embodiment of the Spinal Relaxation Apparatus, the mattress portion includes a rigid layer for supporting the means for providing buoyancy. For most applications, a user will place the apparatus on the floor and then rest face down into the head portion with the chest and abdomen on the mattress and the pelvis on the pelvis support. However, some users may prefer to put the apparatus on their bed or on a cot or on a table—so for these users, one preferably needs to have a board between the apparatus and the bed—so that the flotation aspect will be optimal. Alternative, there may be a tensile frame supporting the mattress portion—for the same reasons.

According to a sixth variation embodiment of the Spinal Relaxation Apparatus, the mattress portion includes a substantially rigid frame for supporting the means for providing buoyancy. A tensile frame (200) structurally provides substantially (almost) the same benefit as the rigid layer (board)—and there are even variations where the tensile frame is optimized as a skeletal silhouette of the spine and chest—in order to at least provide a minimum of symbiotic support for the floatation aspect.

According to a seventh variation embodiment of the Spinal Relaxation Apparatus, the head rotation stabilization portion includes symmetric left and right members wherein said members are interconnected via a forehead rest strap. Perhaps the easiest embodiment is two cushions connect to each other by a forehead strap (133)—where the two cushions are respectively attached to the mattress portion. A person placing his forehead on the forehead strap will then be restricted from lateral motion by the cushions—which pull closer together because of the head's weight on the strap; and an air passage is naturally formed between the cushions simultaneously under the forehead strap. Nevertheless, a second adjustable top-of-the-head strap (134) is preferably also provided so that the two cushions can be pulled together to hold the temples of the head—thereby restricting the head for neck-rotation motions.

Finally, a most general embodiment of the Spinal Relaxation Apparatus, substantially as herein described and illustrated, is characterized by having a spinal-length buoyancy-providing mattress having attached thereto a head rotation stabilization portion on one end and a pelvic support portion on an opposite end. This essentially highlights that a mattress of shape-memory foam will not provide the physiological restriction of head and neck motion nor the pelvis support—against which the spine may begin to relax and rebalance anatomical forces.

Now the DBU apparatus preferred embodiments of the instant invention are a Natural Spine System of "Structure Floating Therapy" for Passive Spinal Decompression. Sinking onto the instant apparatus and implementing even pressure on the body surface that is in contact with apparatus enables the unloading and decompressing of the whole spine. This effect unloads pressure and stress off the spine thus enabling a natural healing process to occur. The Natural Floating Mechanism enables the body to perform a continuous decompression at its own pace. This act is neither activated nor dependent on the user level of pain but on the Spine System ability to gradually withstand Natural Decompression process.

According to the preferred embodiments, (A) a framed apparatus product type is provides that is defined having physical geometry proportions based on human sizes meaning: height, weight, hip circumference, physical condition such as pregnancy. Specifically, sizes are derived from human features. (B) Visco (shape memory) Material have density (weight/volume) 60-100 Kg/M.sup.3, Compression, flexibility, and are flame retardant. (C) Sponge Material are provided for adjustable forehead support with scotch strip for head positioning alignment. (D) An apparatus cover upholstery is provided made of elastic Cotton and Likra to enable total flexibility of the apparatus softness affect. More preferably, a second apparatus cover is also provided that is likewise made of elastic Cotton and Likra; which enables maintaining cleanliness of apparatus.

The apparatus structure is designed and built from 3 primary parts; the inferior one is denser allowing the needed supports of the pelvis. The middle and main parts are softer, in different degrees of softness, and supports the abdominal cavity. The superior part is built of two lateral sides which are joinable to support the forehead, yet enabling free and easy breathing and neck relaxation.

Another DBU device apparatus embodiment is constructed of three primary parts (customized features) relating to human physical attributes; including the superior, middle and inferior parts in different length, height, width sizes and with different density.

The Inferior part is made off Sponge with density features for Pelvis supporting. Preferably: Length 20-40 Cm. Width 50-60 Cm Height: 20-25 Cm. Density—High. Resistance to pressure—high. Sinking rate—low.

The Middle part is made of special Visco Elastic material with density features for Supporting abdomen and shoulder girdle. Preferably: Length 40-50 Cm. Width 40-50-60 Cm Height: 20-25 Cm. Density—Low-variant-embodiment—80-90 Kg/M.sup.3 Medium-variant-embodiment—90-100 Kg/M.sup.3 High-variant-embodiment—110-120 Kg/M.sup.3.

The Superior part is also preferably made of special Visco Elastic material with Adjustable and joinable of two lateral sides using 'scotch strip' for Neck—Head, face and forehead supporting. Length 20 Cm. Width left and right sides (20-22.5)—Space between Lateral Sides 10-15 Cm Height: 20-25 Cm. Density—Low-Medium-High (variants) as in middle part.

(Note: there are Other Measures for Kids, Etc.)

The instant apparatus is a natural passive whole spine system for decompression. The passive resting in prone position of the body enables the natural realignment of the spinal vertebra, relaxation of supporting muscles, tendon and ligaments, and the nerves; thus enabling natural decompression. Natural means with no external force being implemented thus enabling the internal natural healing mechanism to reset itself.

Realignment means the internal natural movement and returning to proper natural positioning of the vertebra in relation to one another and the whole spinal system structure mechanism.

Passive resting, with no external force being implemented beside the Even Pressure support of the apparatus enable relaxation, meditation and emotional relief. Meditation means the ability to rest and even fall a sleep allowing the body to respond to the process with no human awareness and or need for responsibility during process, or activity, or a need for initiated effort; and by no need for any kind of external intervention or irritation to senses.

Prone position and unloading is the intended use position which enables the unloading of the spine system from the belly and internal organs weights and allowing for physical stress relief. It is also enabling the offloading by distributing the pressure over the whole supported frame.

Offloading is enabled only after the unloading. Off loads of stress allows for movement of the vertebrae to the natural place thus relieving pressure off the disks allowing them in turn to realign and to start the process of fluids reabsorbing.

Disks Reabsorbing fluids means the natural recovery process witnessed in the disks thus enabling the disks to re-function actively and recover to the natural structure and functioning. Recovering to Natural structure means the witnessed ability of disks to recover the Annulus Fibrosis as well as the Nucleus Palposus.

Natural spine floating Pool Floating effect Vs. swimming. Using DBU has the effect of naturally unloading stress and pressure of the spine similar to what happens to the body floating in water with out any muscles activation. Such floating provides many advantages, including buoyancy to minimize compressive axial forces, and resistance to muscular forces; thus enabling the spinal reset which then improves the nerves function as well as the internal and external body organs function.

Natural means with no external force being implemented thus enabling the internal natural movement and returning to proper natural positioning of the vertebra in relation to one another and the whole spinal system structure mechanism.

While Pool swimming, water walking and or floating in water may require activation of some muscle groups which relate to the Cervical Spine and Lumbar Spine and thus do not permit total relaxation of the whole Spine System and Limb Joints Systems.

Limb Joints Systems means shoulders joints, elbows joints, wrists joints, hips joints, knees joints and ankles joints. The fact that the majority of swimming strokes promote trunk extension; the sidestroke minimizes extension and rotation, whereas the breaststroke minimizes rotation while creating greater extension forces in the cervical and lumbar spine. Rotational and flexion/extension. (Spinal Fusion and Rehabilitation Aftercare)

Offload of the pressure enables the vertebrae and disks to 'drift apart' This Enables the disks to start reabsorbing fluids thus returning gradually to their optimal size and natural structure. Optimal size meaning the best current possible size under the constraints of the spine system as derived of the accumulated damaged and or degeneration created over the years; thus enabling the spinal reset which then improves the nerves function as well as the internal and external body organs function.

Disks 'self natural recovering process' means recovery process first and then healing process. Recovery means the process of stopping further damage of injured or degenerated area. Healing means the process of restructuring and proper and or better functioning. Disks recovering process starts when less pressure is inflected on the Annulus Fibrosis enables it to renew itself on the long term, recover and gradually strengthen. This process allows the Annulus Fibrosis to better sustain the inflicted pressure by the Nucleus Palposus thus it can returns the Nucleus Palposus to its natural size and shape and modify itself to the disk Annulus Fibrosis natural structure.

This Annulus Fibrosis recovery process is interrelated to a similar and parallel process that takes place with the Nucleus Palposus. The Nucleus Palposus, when witnessing less pressure, is starting the recovery process by re-absorbing body fluids and returning natural size, shape and location in the center of the disk; thus absorbing the disk bulge. This in turn allows for the better bearing of loads and stresses and operates more efficiently to also prevent further deterioration and or damage. This process of Disks' recovery and the fluids re-absorption allow the inter-vertebral space to expand and to begin a 'self natural healing process' gradually.

DBU enabling the recovery process to happen systematically on a daily base relaxes and calms the body and spine system thus allowing the healing process to begin. Healing process means that the body is a self-regulating and self-healing organism.

Nerves root release and rejuvenate with the Spine system unloading and then offloading enables reduced pressure on the inter-vertebral disc thus enabling them to reabsorb fluids and expand. This expansion reduces pressure from the nerves roots; thus enabling them to rejuvenate. Once stress and pressure are reduced from nerves root they can better function thus reduction of symptoms such as pain, breathing problems, digestive and constipation etc.

Relaxing the Cervical Spine System, Spine system unloading and then offloading enables reduced pressure on the inter-vertebral disc thus enabling them to reabsorb fluids and expand. This expansion reduces pressure from the nerves roots; thus enabling them to rejuvenate. Relates to headaches migraines, dizziness, tinnitus, metabolism, Thyroid function, breathing, shoulders pain, upper limbs pain, discomfort. Loss of sensation. C3-C4-C5 nerves which are innovating shift to Innervating the diaphragm—the main and the strongest muscle of the respiratory system. Better rest, Relieves Inter Ocular Pressure etc.

Forehead support for looking downward eliminates pressure and stress from the cervical spine.

Relaxing the thoracic spine system, Spine system unloading and then offloading enables reduced pressure on the inter-vertebral disc thus enabling them to reabsorb fluids and expand. This expansion reduces pressure from the nerves roots; thus enabling them to rejuvenate. Likewise, relates to relaxation for mitigation or relief from adverse headaches migraines, metabolism, lymph Nodes, Heart function, lungs function, liver function, breathing, shoulders pain, upper limbs pain, discomfort, Loss of sensation, Stomach function, duodenum function, Kidney function, Biliary function, Pancreas function, or the likes.

Relaxing the Lumbar spine system. Spine system unloading and then offloading enables reduced pressure on the inter-vertebral disc thus enabling them to absorb fluids and expand. This expansion reduces pressure from the nerves roots; thus enabling them to rejuvenate (e.g. sexual function, digestive function, metabolism, sensation of lower limbs, bladder function, sphincter function, etc.).

Relaxing the sacral spine. Spine system unloading and then offloading enables reduced pressure on the inter-vertebral disc thus enabling them to absorb fluids and expand. This expansion reduces pressure from the nerves roots; thus enabling them to rejuvenate (e.g. sphincter functioning, sexual function, sexual organs, menstrual period, etc.)

The present invention was first planed to support the abdominal mass of a pregnant woman, while supporting the pelvis and giving the abdominal region enough support to enable unloading of pressure and stress off the spinal column. But with a dynamic support of the abdomen in the form of viscous elastic material that will adjust quickly to the shape and size of the female abdomen, assuring no harm could be caused to the fetus. And keeps a height of the cushion that is larger than the most a pregnant abdomen could enlarge to be—assuring no harm to the fetus and/or to the mother.

Pregnant women use of DBU for Spine system release since Pelvis support and development helps to adjust to body changes; to Pelvis balance and labor; to improved Quality of life during nine month pregnancy—sleeping disorders, resting opportunities, to improve vitality and alertness; to Pains reduction; to Limbs numbness and tingling relief; and to helping "heart burns" by relieving pressure off the diaphragm and the related spinal nerves—respectively by supporting the abdominal cavity; supporting the pelvis; and by neck relaxation.

While the invention has been described with respect to specific examples including presently preferred modes of carrying out the invention, those skilled in the art will appreciate that there are numerous variations and permutations of the Spinal Relaxation Apparatus that fall within the spirit and scope of the invention as set forth in the appended claims. For example, the invention has been described related to a specific use for a person prone (face down) on the apparatus with chest and torso on the mattress portion and pelvis on the pelvic support portion, etc.—however there are benefits to a user who rests on the apparatus on a face up position or in a sideways position. Nevertheless, it would be preferable in these alternative resting positions for the person to have the advice of a physiotherapist—who could analyze the persons particular "condition" and suggest simple motion or relaxation exercises to be performed while resting on the apparatus or in conjunction with rest sessions, etc.

In describing the Spinal Relaxation Apparatus of the present invention, explanations are presented in light of currently accepted Physiological theories and Ergonomic models. Such theories and models are subject to changes, both adiabatic and radical. Often these changes occur because representations for fundamental component elements are innovated, because new transformations between these elements are conceived, or because new interpretations arise for these elements or for their transformations. Therefore, it is important to note that the present invention relates to specific technological actualization in embodiments. Accordingly, theory or model dependent explanations herein, related to these embodiments, are presented for the purpose of teaching, the current man of the art how these embodiments may be substantially realized in practice. Alternative or equivalent explanations for these embodiments may neither deny nor alter their realization.

Furthermore, numbers, alphabetic characters, roman symbols, and the likes are designated herein are for convenience of explanations only, and should by no means be regarded as imposing particular order on any method steps, apparatus construction, or the likes.

We claim:

1. A human spinal relaxation apparatus for relaxing a spine of a human comprising:

a mattress portion adapted to provide buoyancy to a torso of the human without supporting a leg of the human, said mattress portion comprised of a shape-memory material layer and having dimensions suitable for supporting the human torso and head, and wherein said mattress portion contains at one end a head rotation stabilization portion; and a layer of inert aggregate comprising a pressurized air entry means for causing the aggregate to emulate buoyancy characteristics by permeating aggregate with air flows, and an air release means for maintaining the air flow permeated aggregate within a predetermined volume.

2. The Spinal Relaxation Apparatus according to claim 1 wherein buoyancy is provided by a "shape-memory foam" layer.

3. The Spinal Relaxation Apparatus according to claim 1 wherein buoyancy is provided by a layer that includes shape memory materials.

4. The Spinal Relaxation Apparatus according to claim 1 wherein said mattress portion includes a rigid layer.

5. The Spinal Relaxation Apparatus according to claim 1 wherein said mattress portion includes a substantially rigid frame.

6. The Spinal Relaxation Apparatus according to claim 1 wherein at one end of the length thereof, there is a pelvic support portion for substantially holding weight of a respective human pelvis thereon.

7. The Spinal Relaxation Apparatus according to claim 6 wherein said pelvic support portion includes a layer having a substantially rigid inner shelf.

8. The Spinal Relaxation Apparatus according to claim 1 wherein said head rotation stabilization portion includes (i) a means for substantially holding weight of a respective human head thereon and (ii) an air passage opening providing means for a person to breathe freely when resting in a face down position thereon.

9. The Spinal Relaxation Apparatus according to claim 3 wherein the shape memory materials are gradually compressing Visco elastic materials.

10. The Spinal Relaxation Apparatus according to claim 9 wherein the Visco elastic materials are adapted to progressively absorb the mass of a human body and reach flotation equilibrium.

* * * * *